US011462135B2

(12) United States Patent
Perez-Bravo et al.

(10) Patent No.: US 11,462,135 B2
(45) Date of Patent: Oct. 4, 2022

(54) CONFIGURABLE DISPLAY APPARATUS AND METHODS

(71) Applicant: Nanolumens Acquisition, Inc., Peachtree Corners, GA (US)

(72) Inventors: Jorge Perez-Bravo, Alpharetta, GA (US); Qinghua Xiao, Nanjing (CN); Bin Zhu, Nanjing (CN)

(73) Assignee: Nanolumens Acquisition, Inc., Peachtree Corners, GA (US)

( * ) Notice: Subject to any disclaimer, the term of this patent is extended or adjusted under 35 U.S.C. 154(b) by 0 days.

(21) Appl. No.: 17/240,394

(22) Filed: Apr. 26, 2021

(65) Prior Publication Data

US 2021/0248934 A1 Aug. 12, 2021

Related U.S. Application Data

(63) Continuation of application No. 16/907,427, filed on Jun. 22, 2020, now Pat. No. 10,991,278, which is a (Continued)

(51) Int. Cl.
*G09F 9/302* (2006.01)
*G09F 7/20* (2006.01)
(Continued)

(52) U.S. Cl.
CPC ..... *G09F 9/3026* (2013.01); *F21V 21/096* (2013.01); *F21V 21/30* (2013.01); *G09F 7/20* (2013.01); *G09F 9/301* (2013.01); *G09F 13/00* (2013.01); *F21S 8/033* (2013.01); *F21S 8/036* (2013.01); *F21V 21/02* (2013.01);
(Continued)

(58) Field of Classification Search
CPC ..... G09F 9/3026; G09F 7/20; G09F 9/301; G09F 13/00; G09F 7/18; G09F 13/04; G09F 19/22; G09F 2007/1852; F21V 21/096; F21V 21/30; F21V 21/02; F21V 21/22; F21V 21/34; F21Y 2105/00; F21S 8/033; F21S 8/036; Y10T 29/49826; Y10T 29/4984
See application file for complete search history.

(56) References Cited

U.S. PATENT DOCUMENTS 5,747,928 A 5/1998 Shanks et al.
6,008,784 A * 12/1999 Acres ..... G09F 9/33 345/55
(Continued)

*Primary Examiner* — Peggy A Neils
(74) *Attorney, Agent, or Firm* — Troutman Pepper Hamilton Sanders LLP; James E. Schutz; Nicholas Doss

(57) ABSTRACT

Display module mounting apparatus and methods provide mounting features enabling ease of installation and service. The apparatus may have one or more releasable frame couplers and pivoting releasable frame couplers coupled to a display module having a display plane defined in relation to a substrate. One or more adjustable linkages may adjustably define a standoff distance between the display plane and a support frame to which the module may be mounted by the mounting apparatus. Concave and convex adjustments to the display plane may be made. Operation of pivoting action to tilt the display plane enables installation, removal, and serviceability of large displays constructed with a tiled plurality of display modules.

20 Claims, 5 Drawing Sheets

Related U.S. Application Data continuation of application No. 16/550,463, filed on Aug. 26, 2019, now Pat. No. 10,692,406, which is a continuation of application No. 15/691,150, filed on Aug. 30, 2017, now Pat. No. 10,410,548, which is a continuation of application No. 15/219,951, filed on Jul. 26, 2016, now Pat. No. 9,754,518, which is a continuation of application No. 15/010,593, filed on Jan. 29, 2016, now Pat. No. 9,404,644, which is a continuation of application No. 14/865,937, filed on Sep. 25, 2015, now Pat. No. 9,279,573.

(60) Provisional application No. 62/113,698, filed on Feb. 9, 2015.

(51) Int. Cl.

| | |
|---|---|
| ***F21V 21/096*** | (2006.01) |
| ***F21V 21/30*** | (2006.01) |
| ***G09F 9/30*** | (2006.01) |
| ***G09F 13/00*** | (2006.01) |
| ***F21S 8/00*** | (2006.01) |
| ***F21Y 105/00*** | (2016.01) |
| ***F21V 21/02*** | (2006.01) |
| ***F21V 21/22*** | (2006.01) |
| ***F21V 21/34*** | (2006.01) |
| ***G09F 7/18*** | (2006.01) |
| ***G09F 13/04*** | (2006.01) |
| ***G09F 19/22*** | (2006.01) |

(52) U.S. Cl.

CPC ..... *F21V 21/22* (2013.01); *F21V 21/34* (2013.01); *F21Y 2105/00* (2013.01); *G09F 7/18* (2013.01); *G09F 13/04* (2013.01); *G09F 19/226* (2013.01); *G09F 2007/1852* (2013.01); *Y10T 29/4984* (2015.01); *Y10T 29/49826* (2015.01)

(56) References Cited

U.S. PATENT DOCUMENTS

| | | | | |
|---|---|---|---|---|
| 6,237,290 | B1 | 5/2001 | Tokimoto et al. | |
| 6,332,690 | B1 | 12/2001 | Murofushi | |
| 6,819,045 | B2 | 11/2004 | Okita et al. | |
| 6,974,971 | B2 | 12/2005 | Young | |
| 7,242,398 | B2 | 7/2007 | Nathan et al. | |
| 7,334,361 | B2 | 2/2008 | Schrimpf et al. | |
| 7,636,085 | B2 | 12/2009 | Yang | |
| 7,710,370 | B2 | 5/2010 | Slikkerveer et al. | |
| 7,714,801 | B2 | 5/2010 | Kimmel | |
| 7,779,568 | B2 | 8/2010 | Gettelfinger et al. | |
| 7,825,582 | B2 | 11/2010 | Furukawa et al. | |
| 7,834,537 | B2 | 11/2010 | Kee et al. | |
| 7,834,962 | B2 | 11/2010 | Satake et al. | |
| 7,868,545 | B2 | 1/2011 | Hioki et al. | |
| 7,877,910 | B2 | 2/2011 | Thorjussen et al. | |
| 7,977,170 | B2 | 7/2011 | Tredwell et al. | |
| 8,021,018 | B2 * | 9/2011 | Zheng | G09F 9/33 362/249.03 |
| 8,023,060 | B2 | 9/2011 | Lin et al. | |
| 8,096,068 | B2 | 1/2012 | Van Rens | |
| 8,097,812 | B2 | 1/2012 | Wang et al. | |
| 8,098,486 | B2 | 1/2012 | Hsiao et al. | |
| 8,228,667 | B2 | 7/2012 | Ma | |
| 8,284,369 | B2 | 10/2012 | Chida et al. | |
| 8,319,725 | B2 | 11/2012 | Okamoto et al. | |
| 8,456,078 | B2 | 6/2013 | Hashimota | |
| 8,471,995 | B2 | 6/2013 | Tseng et al. | |
| 8,477,464 | B2 | 7/2013 | Visser et al. | |
| 8,493,520 | B2 | 7/2013 | Gay et al. | |
| 8,493,726 | B2 | 7/2013 | Visser et al. | |
| 8,654,519 | B2 | 2/2014 | Visser et al. | |
| 8,780,039 | B2 | 7/2014 | Gay et al. | |
| 8,816,977 | B2 | 8/2014 | Rothkopf et al. | |
| 8,873,225 | B2 | 10/2014 | Huitema et al. | |
| 8,982,545 | B2 | 3/2015 | Kim et al. | |
| 9,038,296 | B2 | 5/2015 | Melic | |
| 9,117,384 | B2 | 8/2015 | Phillips et al. | |
| 9,176,535 | B2 | 11/2015 | Bohn et al. | |
| 9,279,573 | B1 | 3/2016 | Perez-Bravo et al. | |
| 9,286,812 | B2 | 3/2016 | Bohn et al. | |
| 9,335,793 | B2 | 5/2016 | Rothkopf | |
| 9,372,508 | B2 | 6/2016 | Wang | |
| 9,459,656 | B2 | 10/2016 | Shai | |
| 10,692,406 | B2 | 6/2020 | Perez-Bravo et al. | |
| 2006/0098153 | A1 | 5/2006 | Slikkerveer et al. | |
| 2006/0204675 | A1 | 9/2006 | Gao et al. | |
| 2007/0000849 | A1 | 1/2007 | Lutz et al. | |
| 2007/0241002 | A1 | 10/2007 | Wu et al. | |
| 2008/0042940 | A1 | 2/2008 | Hasegawa | |
| 2008/0067312 | A1 * | 3/2008 | Allen | F16M 13/02 248/317 |
| 2008/0218369 | A1 | 9/2008 | Krans et al. | |
| 2009/0189917 | A1 | 7/2009 | Benko et al. | |
| 2009/0309494 | A1 | 12/2009 | Patterson et al. | |
| 2011/0134144 | A1 | 6/2011 | Moriwaki | |
| 2012/0002360 | A1 | 1/2012 | Seo et al. | |
| 2012/0092363 | A1 | 4/2012 | Kim et al. | |
| 2012/0251072 | A1 * | 10/2012 | Cope | H04N 21/41415 386/230 |
| 2012/0313862 | A1 | 12/2012 | Ko et al. | |
| 2013/0100392 | A1 | 4/2013 | Fukushima | |
| 2013/0283656 | A1 | 10/2013 | Melic | |
| 2014/0267457 | A1 * | 9/2014 | Jurewicz | G09F 9/372 345/690 |
| 2014/0314999 | A1 | 10/2014 | Song et al. | |
| 2016/0127674 | A1 | 5/2016 | Kim | |

* cited by examiner

CONFIGURABLE DISPLAY APPARATUS AND METHODS

CROSS REFERENCE TO RELATED APPLICATIONS

This continuation utility application claims the benefit of U.S. non-provisional utility application Ser. No. 16/907,427, filed Jun. 22, 2020, entitled "Configurable Display Apparatus and Methods". Application Ser. No. 16/907,427 claims the benefit of U.S. non-provisional utility application Ser. No. 16/550,463, filed Aug. 26, 2019, entitled "Configurable Display Apparatus and Methods". Application Ser. No. 16/550,463 claims the benefit of U.S. non-provisional utility application Ser. No. 15/691,150, filed Aug. 30, 2017, entitled "Configurable Display Apparatus and Methods". Application Ser. No. 15/691,150 claims the benefit of U.S. non-provisional utility application Ser. No. 15/219,951, filed Jul. 26, 2016, entitled "Front Serviceable Mounting Apparatus and Methods". Application Ser. No. 15/219,951 claims the benefit of U.S. non-provisional utility application Ser. No. 15/010,593, filed Jan. 29, 2016, entitled "Front Serviceable Mounting Apparatus and Methods". Application Ser. No. 15/010,593 claims the benefit of U.S. non-provisional utility application Ser. No. 14/865,937, filed Sep. 25, 2015, entitled "Front Serviceable Mounting Apparatus and Methods". Application Ser. No. 14/865,937 claims the benefit of U.S. provisional Application No. 62/113,698, filed Feb. 9, 2015, entitled "Display Module Mounting Apparatus and Methods". Application Ser. Nos. 16/907,427, 16/550,463, 15/691,150, 15/219,951, 15/010,593, 14/865,937, and 62/113,698 are incorporated herein by reference.

BACKGROUND

The sense of sight is utterly compelling to those human beings who possess it. The adage that a picture is worth a thousand words resonates with an appreciation of the profound importance of taking in visual information. The sense of sight is unique in allowing us to absorb so much information from our world so quickly. It is natural then that entertainers, artists, and advertisers all want to engage people with their own visual content for the purpose creating a desired response in their intended audience. A visual display system is one of the ways that people can experience the presentation of visual information and it is the focus of the present disclosure.

There are numerous features of a visual display system that contribute to its impact upon viewers including: size, brightness, contrast, color saturation, color depth, display refresh rate, resolution, pixel pitch, pixel pitch uniformity, and others.

There are numerous other features of a visual display system that are of interest to the owners and operators of such systems including: ease of installation, ease of service, reliability, ease of configuration, ease of maintenance, ease of operation, cost of the system, cost of installation, cost of operation, cost of service, and others.

In consideration of the foregoing points, it is clear that embodiments of the present disclosure confer numerous advantages and are therefore highly desirable.

SUMMARY

A large visual display may be constructed from a plurality of generally planar display modules tiled into a predetermined pattern leaving no gaps and creating no overlaps between display modules. Each display module may have a plurality of light emitting elements arranged onto a display plane in a predetermined pattern and thereby creating a highly uniform visual effect. The perimeter region of each display plane may be designed such that abutting and aligning the display planes of adjacent display modules allows continuation, without visual aberration, of the pattern of light emitting elements across the boundary between adjacent display modules. The plurality of display modules, suitably abutted and aligned, collectively create a viewing plane that is free from visible aberration.

A pitch distance may be defined between adjacent light emitting elements within a single display module. The predefined pattern of light emitting elements may be designed to provide a highly uniform pitch distance across an individual display module. The perimeter region of each display plane may be designed so that the pitch distance across adjacent display modules is substantially the same as the pitch distance within a single display module. A highly uniform visual effect across an entire plurality of display modules may thereby be created.

A large visual display assembled from a plurality of display modules may have an underlying support frame structure onto which the plurality of display modules may be assembled. Abutment and alignment of the display planes of adjacent display modules is an important factor in the overall visual quality of the large visual display. In such display systems it is important to be able to: install display modules onto the support frame with the necessary alignment and abutment; service a display module that has previously been installed onto the support frame without disturbing adjacent display modules; and remove a display module that has previously been installed onto the support frame without removing or significantly disturbing adjacent display modules. Novel display module mounting apparatus and methods may be used to accomplish these highly desirable goals.

Exemplary embodiment 1.0 According to an embodiment of the present disclosure an apparatus for mounting a display module to a support frame, the display module having a display plane coupled to a substrate, said apparatus comprising:

- a releasable frame coupler coupled to said substrate and providing a first standoff distance between said display plane and said support frame;
- a pivoting releasable frame coupler coupled to said substrate and providing a second standoff distance between said display plane and said support frame;
- an adjustable linkage coupled between said pivoting releasable frame coupler and said display plane, said adjustable linkage operative to provide an adjustable deflection of at least a portion of said display plane.

Exemplary embodiment 1.0a According to another embodiment of the present disclosure, exemplary embodiment 1.0 is further characterized as having both an installed position and a service position, said installed position defined when said releasable frame coupler and said pivoting releasable frame coupler are both coupled to said support frame, said service position defined when said pivoting releasable frame coupler is coupled to said support frame and said releasable frame coupler is not coupled to said support frame.

Exemplary embodiment 1.0b According to another embodiment of the present disclosure, exemplary embodiment 1.0a is further characterized in that said display plane is disposed at a first angle with respect to said pivoting releasable frame coupler when in said installed position, said display plane is disposed at a second angle with respect to said pivoting releasable frame coupler when in said service position; and wherein said first angle and said second angle are not equal.

Exemplary embodiment 1.0c According to another embodiment of the present disclosure, exemplary embodiment 1.0 or 1.0a or 1.0b is further characterized in that said releasable frame coupler and pivoting releasable frame coupler couple to said support frame by means of magnetic attraction.

Exemplary embodiment 1.1 According to another embodiment of the present disclosure, exemplary embodiment 1.0 is further characterized in that the releasable frame coupler is an adjustable releasable frame coupler that provides an adjustable first standoff distance between said plane and said support frame.

Exemplary embodiment 1.2 According to another embodiment of the present disclosure, exemplary embodiment 1.0 is further characterized in that the pivoting releasable frame coupler is an adjustable pivoting releasable frame coupler that provides an adjustable second standoff distance between said plane and said support frame.

Exemplary embodiment 1.3 According to another embodiment of the present disclosure, exemplary embodiment 1.0 is further characterized in that the adjustable linkage has a neutral position providing no deflection of the display plane.

Exemplary embodiment 1.4 According to another embodiment of the present disclosure, exemplary embodiment 1.0 is further characterized in that the adjustable linkage is operable in compression to provide said adjustable deflection of at least a portion of said display plane.

Exemplary embodiment 1.5 According to another embodiment of the present disclosure, exemplary embodiment 1.0 is further characterized in that the adjustable linkage is operable in tension to provide said adjustable deflection of at least a portion of said display plane.

Exemplary embodiment 1.6 According to another embodiment of the present disclosure, exemplary embodiment 1.0 is further characterized in that the adjustable linkage is operable in both tension and compression to provide said adjustable deflection of at least a portion of said display plane.

Exemplary embodiment 1.7 According to another embodiment of the present disclosure, exemplary embodiment 1.0 is further characterized in that the adjustable linkage is operable in to provide an adjustable concave deflection of at least a portion of said display plane.

Exemplary embodiment 1.8 According to another embodiment of the present disclosure, exemplary embodiment 1.0 is further characterized in that the adjustable linkage is operable in to provide an adjustable convex deflection of at least a portion of said display plane.

Exemplary embodiment 1.9 According to another embodiment of the present disclosure, exemplary embodiment 1.0 is further characterized in that the adjustable deflection of at least a portion of said display plane is concave or convex or flat.

Exemplary embodiment 2.0 According to another embodiment of the present disclosure, an apparatus for mounting a display module to a support frame, the display module having a display plane coupled to a substrate, said apparatus comprising:

a support rib coupled to said substrate, opposed to and substantially parallel to said display plane, said support rib having a first portion and a second portion;

a releasable frame coupler coupled to said first portion of said support rib and providing a first standoff distance between said display plane and said support frame;

a pivoting releasable frame coupler coupled to said first portion of said support rib and providing a second standoff distance between said display plane and said support frame;

an adjustable linkage coupled between said first portion of said support rib and said second portion of said support rib, said adjustable linkage operative to provide an adjustable deflection of at least a portion of said display plane.

Exemplary embodiment 3.0 According to another embodiment of the present disclosure, an apparatus for mounting a display module to a support frame, the display module having a display plane coupled to both a first support rib and a second support rib, said apparatus comprising:

a releasable frame coupler coupled to said first support rib and providing a first standoff distance between said display plane and said support frame;

a pivoting releasable frame coupler coupled to said first support rib and providing a second standoff distance between said display plane and said support frame;

an adjustable linkage coupled between said first support rib and said second support rib, said adjustable linkage operative to provide an adjustable deflection of at least a portion of said display plane.

Exemplary embodiment 4.0 According to an embodiment of the present disclosure, a display module for mounting to a support frame comprises:

a display module having a plurality of light emitting elements coupled to a substrate and arranged in a predetermined pattern forming a display plane;

a releasable frame coupler coupled to said substrate and providing a first standoff distance between said display plane and said support frame;

a pivoting releasable frame coupler coupled to said substrate and providing a second standoff distance between said display plane and said support frame;

an adjustable linkage coupled between said pivoting releasable frame attachment and said display plane, said adjustable linkage operative to provide an adjustable deflection of at least a portion of said display plane.

Exemplary embodiment 4.0a According to another embodiment of the present disclosure, exemplary embodiment 4.0 is further characterized as having both an installed position and a service position, said installed position defined when said releasable frame coupler and said pivoting releasable frame coupler are both coupled to said support frame, said service position defined when said pivoting releasable frame coupler is coupled to said support frame and said releasable frame coupler is not coupled to said support frame.

Exemplary embodiment 4.0b According to another embodiment of the present disclosure, exemplary embodiment 4.0a is further characterized in that said display plane is disposed at a first angle with respect to said pivoting releasable frame coupler when in said installed position, said display plane is disposed at a second angle with respect to said pivoting releasable frame coupler when in said service position; and wherein said first angle and said second angle are not equal.

Exemplary embodiment 4.0c According to another embodiment of the present disclosure, exemplary embodiment 4.0 or 4.0a or 4.0b is further characterized in that said releasable frame coupler and pivoting releasable frame coupler couple to said support frame by means of magnetic attraction.

Exemplary embodiment 5.0 According to another embodiment of the present disclosure, a system for mounting a plurality of display modules comprising:

a support frame operative to support the weight of said plurality of display modules along a support direction, and operative to comply with curvature of said support frame in directions orthogonal to said support direction;

each of said plurality of display modules comprising a plurality of light emitting elements coupled to a substrate and arranged according to a predetermined pattern forming a display plane;

each of said plurality of display modules mounted to said support frame by a mounting apparatus comprising:

a releasable frame coupler coupled to said substrate and providing a first standoff distance between said display plane and said support frame;

a pivoting releasable frame coupler coupled to said substrate and providing a second standoff distance between said display plane and said support frame;

an adjustable linkage coupled between said pivoting releasable frame coupler and said display plane, said adjustable linkage operative to provide an adjustable deflection of at least a portion of said display plane.

BRIEF DESCRIPTION OF THE DRAWINGS

The above and other objects, features, and advantages of the present disclosure will become apparent from the following description of preferred embodiments given in conjunction with the accompanying drawings, in which:

FIG. 3A and FIG. 3B shows side views of a display module mounting apparatus according to the present disclosure in which FIG. 3A shows an installed position and FIG. 3B shows a service position.

LIST OF REFERENCE NUMBERS APPEARING IN THE FIGURES

Figure 1:
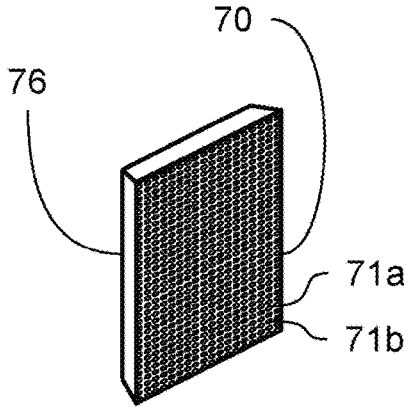
FIG. 1 shows a perspective view of a display module according to the present disclosure.

2—display module mounting apparatus
3—installed position of display module mounting apparatus
5—service position of display module mounting apparatus
10—releasable frame coupler
11—standoff distance between display plane and support frame provided by 10
12—adjustable releasable frame coupler
13—adjustable standoff distance between display plane and support frame provided by 12
20—pivoting releasable frame coupler
21—standoff distance between display plane and support frame provided by 20
22—adjustable pivoting releasable frame coupler
23—adjustable standoff distance between display plane and support frame provided by 22
30—adjustable linkage
31—adjustable standoff distance between display plane and support frame provided by 30
40—support frame
41—support direction
42—support frame aperture
42*a*, 42*b*, etc.—first, second, etc. support frame aperture
50—support rib
50F—first portion of support rib 50
50S—second portion of support rib 50
50*a*, 50*b*—first support rib, second support rib
70—display module
70*a*, 70*b*, 70*c* etc.—first, second, third, etc. display module
71—light emitting element
71*a*, 71*b*, etc.—first, second, etc. light emitting element
72—plurality of light emitting elements
74—display plane
74D—display plane having a deflection
74V—display plane having a concave deflection
74X—display plane having a convex deflection

75I—display plane disposed at a first angle with respect to the viewing plane when in the installed position

75S—display plane disposed at a second angle with respect to the viewing plane when in the service position

76—display module substrate

80—viewing plane

DETAILED DESCRIPTION

Embodiments of the present disclosure provide display module mounting apparatus and methods. A large visual display may be constructed from a plurality of generally planar display modules tiled into a predetermined pattern leaving no gaps and creating no overlaps between display modules. Each display module may have a plurality of light emitting elements arranged onto a display plane in a predetermined pattern and thereby creating a highly uniform visual effect. The perimeter region of each display plane may be designed such that abutting and aligning the display planes of adjacent display modules allows continuation, without visual aberration, of the pattern of light emitting elements across the boundary between adjacent display modules. The plurality of display modules, suitably abutted and aligned, collectively create a viewing plane that is free from visible aberration.

A pitch distance may be defined between adjacent light emitting elements within a single display module. The predefined pattern of light emitting elements may be designed to provide a highly uniform pitch distance across an individual display module. The perimeter region of each display plane may be designed so that the pitch distance across adjacent display modules is substantially the same as the pitch distance within a single display module. A highly uniform visual effect across an entire plurality of display modules may thereby be created.

Turning now to FIG. 1, a perspective view is shown of an embodiment of a display module 70 comprising a plurality of light emitting elements coupled to a substrate 76, of which a first light emitting element 71*a* and a second light emitting element 71*b* are representative of the plurality, the plurality arranged in a predetermined pattern and forming a display plane 74. Consistent with the foregoing descriptions, FIG. 2A shows a frontal view of display plane 74 of display module 70, having a highly uniform pattern in the arrangement of the plurality of light emitting elements 72.

Large tiled displays are often mounted on existing architectural features. These architectural features often present physical imperfections such undulations, unevenness, ripples, ridges, gaps, etc that can impact the alignment and position of any support frame that is mounted thereupon for the purpose of supporting a large tiled display. Unless special measures are taken to ameliorate the underlying imperfections of the architectural features, the final tiled assembly of display modules may show the imperfections caused by the uneven mounting environment. Embodiments of the present disclosure describe novel display module mounting apparatus and methods that may be used to ameliorate the unevenness in the underlying architectural features upon which the support frame and ultimately the large tiled display are mounted.

A large visual display assembled from a plurality of display modules may have an underlying support frame structure onto which the plurality of display modules may be assembled. Abutment and alignment of the display planes of adjacent display modules is an important factor in the overall visual quality of the large visual display. In such display systems it is important to be able to: install display modules onto the support frame with the necessary alignment and abutment; service a display module that has previously been installed onto the support frame without disturbing adjacent display modules; and remove a display module that has previously been installed onto the support frame without removing or significantly disturbing adjacent display modules.

Figure 2A:
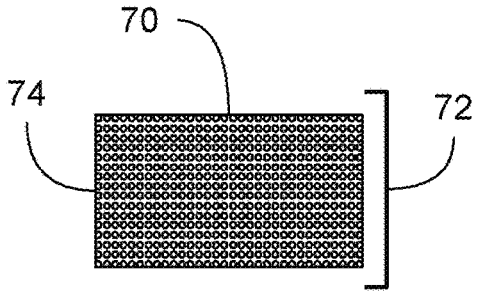
FIG. 2A shows a front view of a display module according to the present disclosure, showing a plurality of light emitting elements arranged in a predetermined pattern and forming a display plane.
Figure 2B:
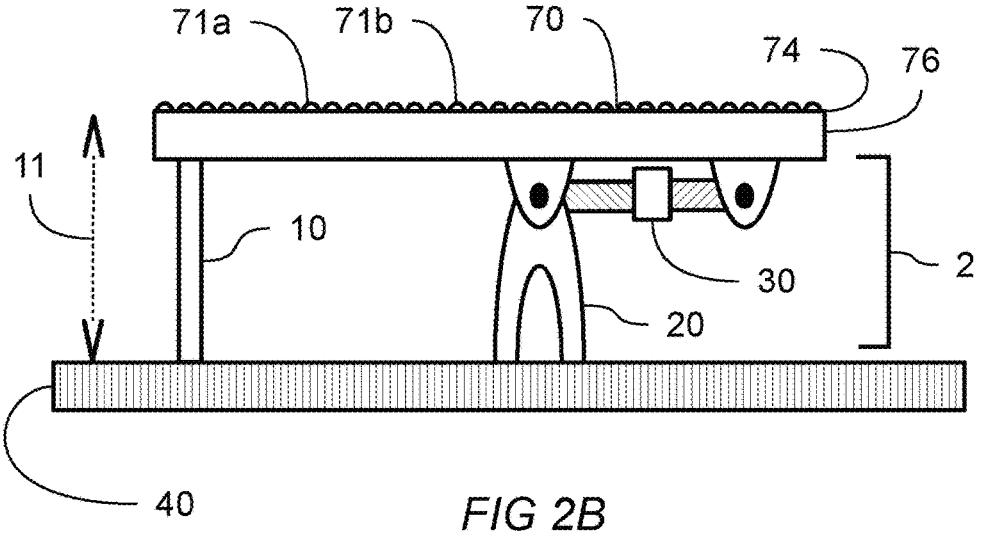
FIG. 2B shows a side view of the display module of FIG. 2A and associated mounting apparatus for mounting the display module on a support frame.

Turning now to FIG. 2B, shown is a side view of the display module of FIG. 2A, now showing associated display module mounting apparatus 2 for mounting the display module on a support frame. Display module 70 is shown comprising first light emitting element 71*a* and second light emitting element 71*b*, which are two members of the plurality of light emitting elements coupled to substrate 76 and formed into display plane 74. The mounting apparatus is shown, in operational relation to a support frame 40, comprising: a releasable frame coupler 10 coupled to substrate 76 and providing a first standoff distance 11 between display plane 74 and support frame 40; a pivoting releasable frame coupler 20 coupled to substrate 76 and providing a second standoff distance 21 between display plane 74 and support frame 40; an adjustable linkage 30 coupled between pivoting releasable frame coupler 20 and the display plane, adjustable linkage 30 being operative to provide an adjustable deflection of at least a portion of display plane 74.

Figure 7A:
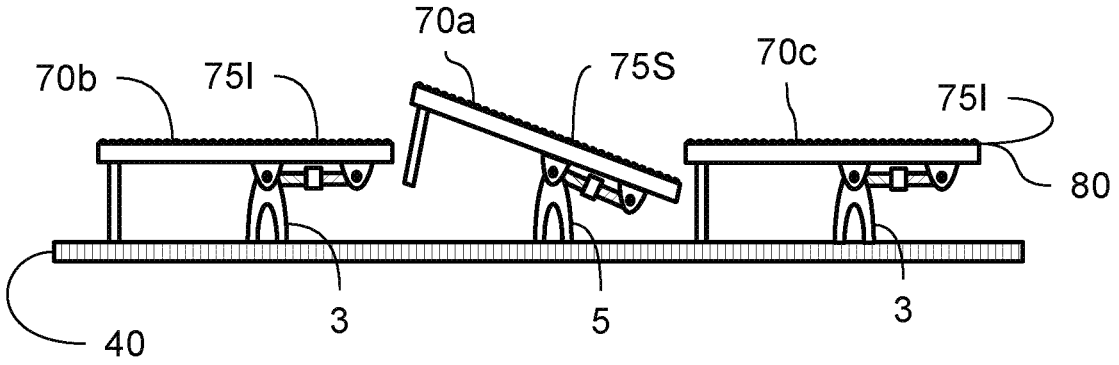
FIG. 7A shows a side view of a system of display modules mounted to a support frame, and in which the center display module is in the service position while the two adjacent display modules are in the installed position.
Figure 7B:
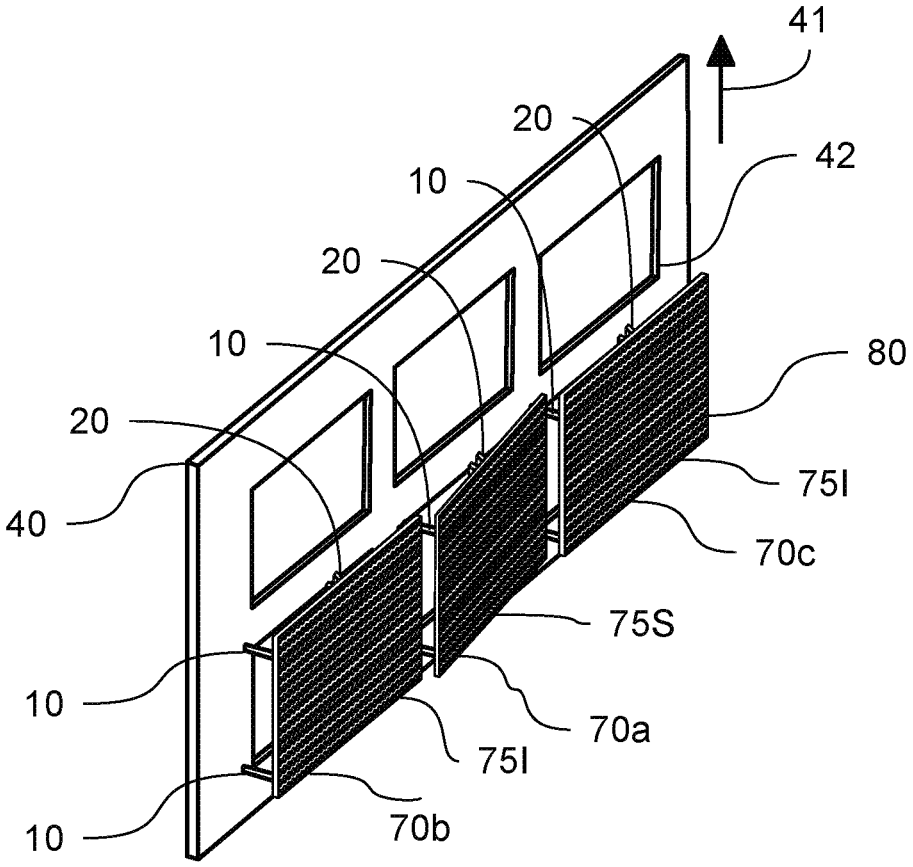
FIG. 7B shows a perspective view of the system of display modules shown in FIG. 7A. The center display module has been operated into the service position to facilitate installation and service without disturbing the position or alignment of adjacent display modules.

The display plane 74 of FIG. 2B is shown in a neutral position in which the display plane is substantially flat. When the display plane is substantially flat it can be seen that a standoff distance of the overhanging portion of the display plane may be defined which is associated with the flatness of the display plane. Pivoting releasable frame coupler 20 is operable to provide a tilting action to the display plane that may be operated by applying a force to the display plane in proximity to the overhanging portion of the display plane. The display plane is shown in FIG. 3B, FIG. 7A, and FIG. 7B, in a attitude which is angled with respect to the viewing plane, the viewing plane having been established by the collective installation of a plurality of display modules. Ease of installation, removal, and service of a display module is enhanced by being able to tilt the display plane of a module without substantially impacting the alignment and position of adjacent display modules installed according to the viewing plane.

Figure 2C:
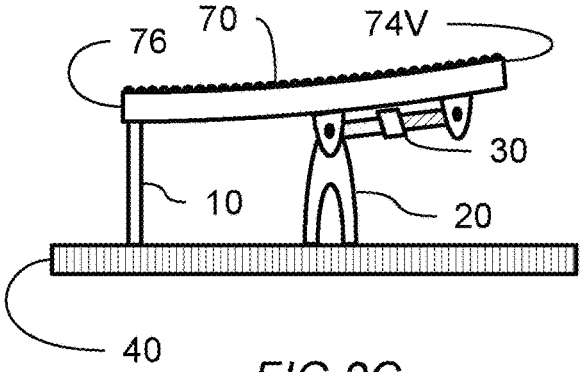
FIG. 2C shows a side view of the apparatus of FIG. 2B in which the display plane has been deflected from flat into a concave shape.

Continuing with FIG. 2C, shown is a side view of the apparatus of FIG. 2B, in which adjustable linkage 30 has been operated to produce a display plane having a concave deflection 74V. Releasable frame coupler 10 continues to provide the first standoff distance between support frame 40 and the portion of display plane 74V closest to that coupler. At the same time, adjustable linkage 30 is operable to change the standoff distance of the overhanging portion of the display plane from the flat disposition shown in FIG. 2B to a different standoff distance. This adjustability allows the mounting apparatus to compensate for underlying unevenness to which the support frame may be mounted, thereby producing an improved visual effect.

Figure 2D:
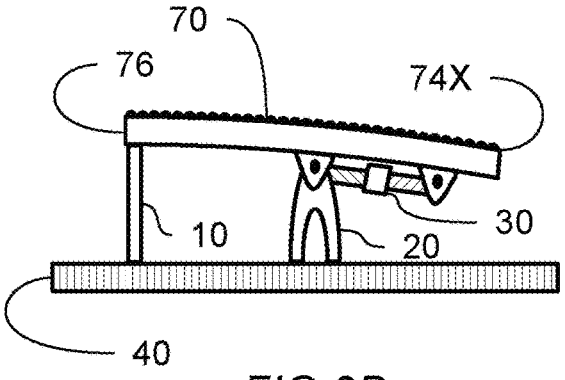
FIG. 2D shows a side view of the apparatus of FIG. 2B in which the display plane has been deflected from flat into a convex shape.

Continuing with FIG. 2D, shown is a side view of the apparatus of FIG. 2B, in which adjustable linkage 30 has been operated to produce a display plane having a convex deflection 74X. Releasable frame coupler 10 continues to provide the first standoff distance between support frame 40 and the portion of display plane 74X closest to that coupler. At the same time, adjustable linkage 30 is operable to change the standoff distance of the overhanging portion of the display plane from the flat disposition shown in FIG. 2B to a different standoff distance. This adjustability allows the mounting apparatus to compensate for underlying unevenness to which the support frame may be mounted, thereby producing an improved visual effect.

The apparatus of FIGS. 2B, 2C, and 2D show adjustable linkage 30 in a neutral, compression, and tension condition respectively. In preferred embodiments, adjustable linkage may operate by means of threaded and thread receiving members, the linkage lengthening and shortening in response to rotating one of the threaded or thread receiving members. Other embodiments are possible still within the scope of the disclosure.

In order to flex in response to the operation of linkage 30, substrate 76 is not strictly rigid but rather requires sufficient flexibility to physically comply with the mechanical urging of the adjustable linkage. It can also be seen that the position of the pivoting releasable frame coupler 20, length of adjustable linkage 30, the mechanical advantage of adjustable linkage 30, and the location and way in which adjustable linkage 30 is coupled to display plane 74, all may be varied within the scope of this disclosure to provide variations in deflection of display plane 74.

Figure 3A:
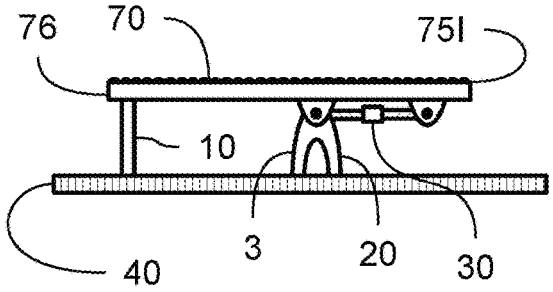
Figure 3B:
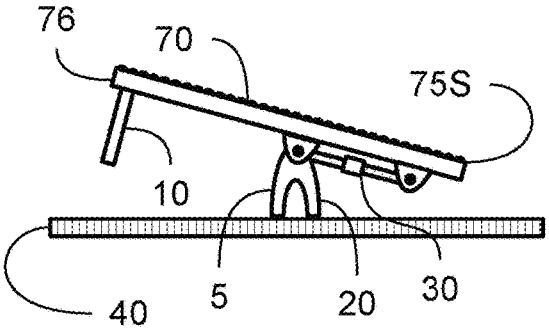

Turning now to FIG. 3A and FIG. 3B, shown are side views of a display module mounting apparatus according to the present disclosure. FIG. 3A shows an installed position 3 in which the display plane 75I is disposed at a first angle which is substantially parallel to the local viewing plane of the large tiled display. FIG. 3B shows the same apparatus in a service position 5 in which the display plane 75S is disposed at a second angle with respect to the local viewing plane. Starting in the installed position 3, service position 5 may be arrived at by pressing on the overhanging portion of display plane 751 with sufficient force to cause releasable frame coupler 10 to release from support frame 40 and thereafter pivot by means of pivoting releasable frame coupler 20. In preferred embodiments, service position 5 provides, by tilting the display plane, enough space for a person to grasp display module 70 and thereafter cause the release of pivoting releasable frame coupler 20. In preferred embodiments, the releasable couplers operate by means of magnetic attraction, other embodiments being within the spirit and scope of the disclosure.

Figure 4A:
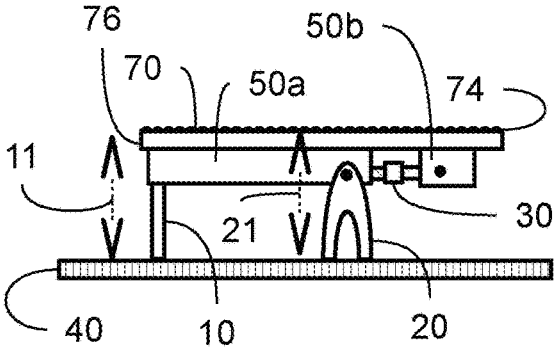
FIG. 4A shows a side view of a display module mounting apparatus according to the present disclosure in which two support ribs are coupled to the substrate of the display module.

Now with reference to FIG. 4A, shown is a side view of a display module mounting apparatus according to the present disclosure comprising: a first support rib 50*a* and a second support rib 50*b* both coupled to substrate 76 of display module 70; releasable frame coupler 10 coupled to first support rib 50*a* and providing first standoff distance 11 between display plane 74 and support frame 40; pivoting releasable frame coupler 20 coupled to first support rib 50*a* and providing second standoff distance 21 between display plane 74 and support frame 40; and an adjustable linkage 30 coupled between first support rib 50*a* and second support rib 50*b*, in which adjustable linkage 30 is operative to provide an adjustable deflection of at least a portion of display plane 74.

Figure 4B:
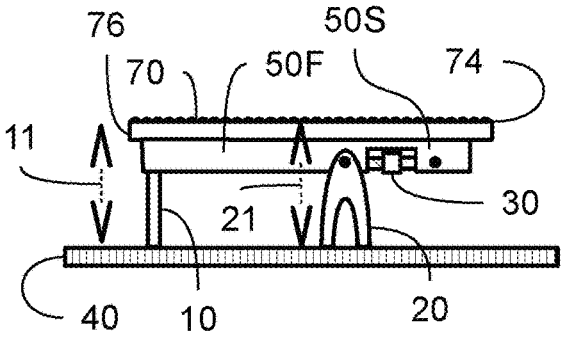
FIG. 4B shows a side view of a display module mounting apparatus according to the present disclosure in which a support rib having a first portion and a second portion is coupled to the substrate of the display module.

Continuing with FIG. 4B, shown is a side view of a display module mounting apparatus according to the present disclosure comprising: a support rib coupled to substrate 76 and having a first portion 50F and a second portion 505; releasable frame coupler 10 coupled to first portion 50F of the support rib and providing first standoff distance 11 between display plane 74 and support frame 40; pivoting releasable frame coupler 20 coupled to first portion 50F of the support rib and providing second standoff distance 21 between display plane 74 and support frame 40; and an adjustable linkage 30 coupled between first portion 50F and second portion 505, in which adjustable linkage 30 is operative to provide an adjustable deflection of at least a portion of display plane 74.

Figure 5A:
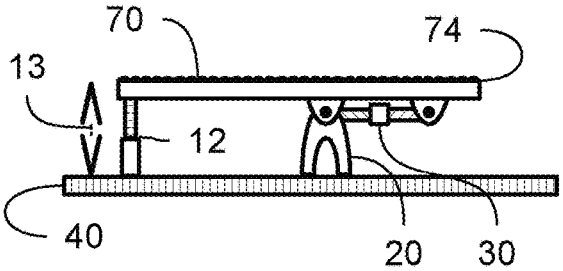
FIG. 5A shows a side view of a display module mounting apparatus according to the present disclosure in which an adjustable releasable frame coupler is operative to provide an adjustable standoff distance between display plane and support frame.

According to another embodiment of the present disclosure, shown in FIG. 5A, the releasable frame coupler may be an adjustable releasable frame coupler 12 that is operative to provide an adjustable standoff distance 13 between display plane 74 and support frame 40. In preferred embodiments, the adjustability may be provided by means of threaded and thread receiving members, in which adjustable releasable frame coupler 12 may lengthen and shorten in response to rotating one of the threaded or thread receiving members with respect to the other. Other embodiments are possible within the scope and spirit of the disclosure.

Figure 5B:
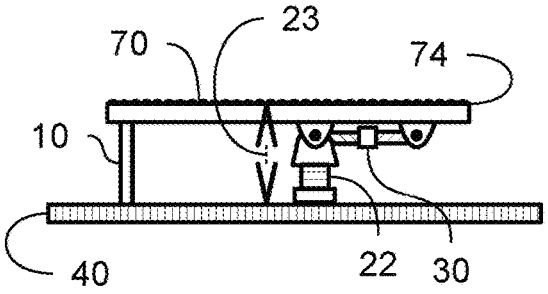
FIG. 5B shows a side view of a display module mounting apparatus according to the present disclosure in which an adjustable pivoting releasable frame coupler is operative to provide an adjustable standoff distance between display plane and support frame.

According to another embodiment of the present disclosure, shown in FIG. 5B, the pivoting releasable frame coupler may be an adjustable pivoting releasable frame coupler 22 that is operative to provide an adjustable standoff distance 23 between display plane 74 and support frame 40. In preferred embodiments, the adjustability may be provided by means of threaded and thread receiving members, in which adjustable pivoting releasable frame coupler 22 may lengthen and shorten in response to rotating one of the threaded or thread receiving members with respect to the other. Other embodiments are possible within the scope and spirit of the disclosure.

Figure 6A:
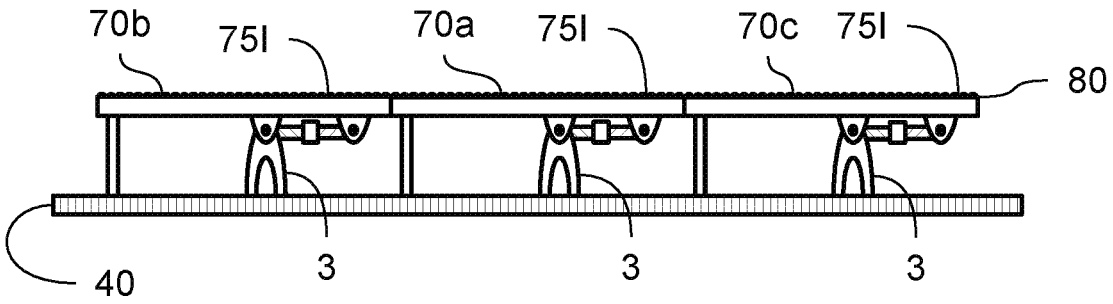
FIG. 6A shows a side view of a system of display modules mounted to a support frame and collectively creating a viewing plane having no gaps and no overlaps between adjacent display modules. Each of the display modules is shown in the installed position.
Figure 6B:
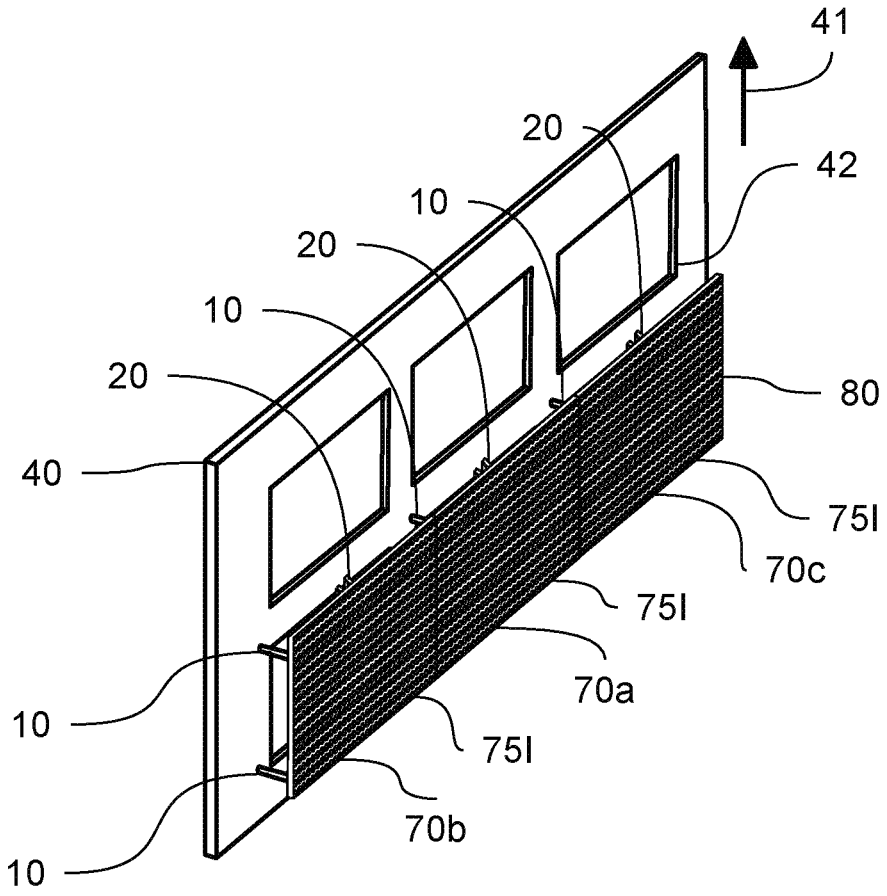
FIG. 6B shows a perspective view consistent with the system of display modules shown in FIG. 6A. One display module is shown in the service position.

FIG. 6A shows a side view of a system of display modules mounted to a support frame and collectively creating a viewing plane 80 having no gap and no overlaps between adjacent display modules. Each of the display modules is shown in the installed position. First, second, and third display modules 70*a*, 70*b*, and 70*c*, respectively, are each coupled to support frame 40 by means of display module mounting apparatus, each of which is in its installed position 3. FIG. 6A shows that, in the installed position, each of the display modules has a display plane 751 disposed at a first angle with respect to viewing plane 80. FIG. 6B is a perspective view of the apparatus of FIG. 6A, in which the features providing a controlled standoff distance between support frame 40 and the plurality of display planes are visible. First, second, and third display modules 70*a*, 70*b*, and 70*c*, respectively, are each provided with one or more releasable frame couplers 10 and one or more pivoting releasable frame couplers 20 for establishing standoff distances between the plurality of display planes 751 and support frame 40. Support frame 40 is shown with a plurality of apertures 42, which may be useful for routing power and control signals as well as for granting access to a portion of the back side of one or more display modules. It can be seen from the figure that one or more releasable frame couplers and one or more pivoting releasable frame couplers may be used to support each display module. Couplers operating by means of magnetic attraction are preferred.

FIG. 7A shows the system of FIG. 6A in which first display module 70*a* has been moved into service position 5. In preferred embodiments, a display module previously installed on support frame 40 may be moved into a service position 5 by causing releasable frame coupler 10 to release from support frame 40, thereafter operating the pivoting releasable frame coupler 20 to tilt the display plane up to an angle that permits grasping the thickness of the display plane and substrate. Once grasped, the module can be further manipulated into releasing the pivoting releasable frame coupler thereby effecting the removal of the display module from the support frame.

The support frame 40 of FIG. 6B, FIG. 7B, FIG. 9A, FIG. 9B is operative to support the weight of the plurality of installed display modules along support direction 41, while being compliant enough in directions orthogonal, or partially orthogonal, to support direction 41 so as to comply with the variations, unevenness, etc of the structure to which support frame 40 is itself mounted. Support frame materials including plastic and metal may be employed in preferred embodiments. Support frame 40 may thereby be structurally robust and yet curve gracefully in response to variations of the underlying mounting structure.

FIG. 7B is a perspective view of the apparatus of FIG. 7A. It can be seen that in the service position, first display module 70*a* has a display plane 75S disposed at a second angle with respect to viewing plane 80. The viewing plane is created collectively by a plurality of display modules that are in installed positions. In the figure the service position provides a position in which the thickness of the display plane and substrate are graspable for further manipulation of the display module. The process of removing a display module may be reversed to arrive at an installation process and clearly both removal and installation are within the spirit and scope of the present disclosure. In addition, removal and installation of a display module can be completed entirely from the front side of the display, without substantially disturbing the alignment or position of the adjacent display modules. Also, with a support frame having a plurality of apertures 42 of sufficient size to pass a display module through the support frame aperture, installation and removal may be completed entirely from the back side of the display.

Figure 8:
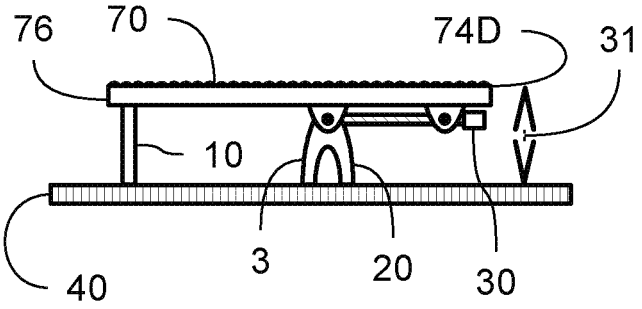
FIG. 8 shows an embodiment of a display module mounting apparatus featuring an adjustable linkage that is operative to provide an adjustable standoff distance between support frame and display plane.

Turning now to FIG. 8, shown is another embodiment of a display module mounting apparatus featuring an adjustable linkage 30 that is operative to provide an adjustable standoff distance 31 between support frame 40 and display plane 74D. Adjustable linkage 30 is oriented with respect to display plane 74D so that access to operate the adjustable linkage is beneficially located near the edge of the display plane 74D. A person seeking to adjust the adjustable linkage can do so with relative ease due to the convenient location near the edge of the display module. Adjustable linkage 30 is operative to increase and/or decrease adjustable standoff distance 31. Display plane 74D may be deflected by the operation of the adjustable linkage and thereby take a convex, concave, or flat shape.

Figure 9A:
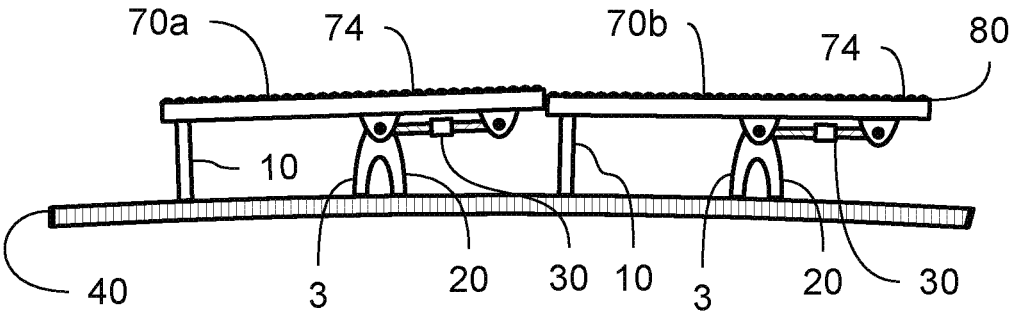
FIG. 9A and FIG. 9B illustrate the operation of embodiments of the present disclosure when the underlying support frame takes on an uneven or curved conformation.
Figure 9B:
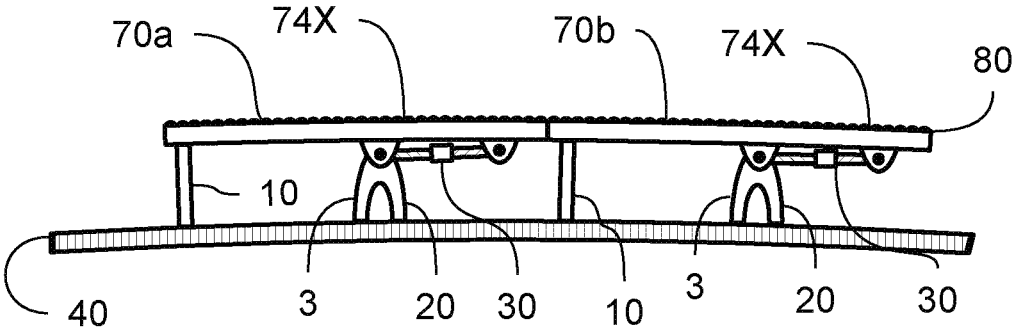

FIG. 9A and FIG. 9B together further illustrate clear benefits of embodiments of the present disclosure when the underlying support frame 40 takes on an uneven or curved conformation. FIG. 9A shows first display module 70*a* and second display module 70*b* adjacent to each other and both mounted to support frame 40 which is curved to illustrate a real world difficulty encountered in installations of large tiled displays. The display modules of FIG. 9A are shown with their individual display planes 74 flat thus making a visible discontinuity in the viewing plane where the two display planes meet. The apparatus of FIG. 9A may be configured by operation of the adjustable linkages on both first display module 70*a* and second display module 70*b* to eliminate the visible discontinuity between display planes shown in FIG. 9A.

It can be seen in FIG. 9B that the adjustable linkages enable the adjustment of the shapes and standoff distances of the display planes so that they collectively present a smoothly curving viewing plane despite the unevenness, curvature, and irregularities of the underlying support frame 40. FIG. 9B shows the result of using the adjustable linkage 30 of first display module 70*a* to adjust the standoff distance of the overhanging portion of the display plane, thereby creating a smooth transition between the convex display plane 74X of first display module 70*a* and the convex display plane 74X of second display module 70*b*. It can be further seen that adjustable linkage 30 of second display module 70*b* can be operated to accommodate the curvature of the support frame 40. The second display module 70*b* of FIG. 9B can be seen to be ready for the installation of yet another display module, not shown. Together, FIGS. 9A and 9B show the steps involved in installing a large display created by tiling with display modules according to the present disclosure. Each display module may be coupled with display module mounting apparatus and installed onto a support frame, one adjacent display module after the next, each new display plane adjusted by means of the adjustable linkage in preparation for matching the standoff distance of the display plane of the next display module.

Although the present invention has been described in considerable detail with reference to certain preferred versions thereof, other versions are possible. It may be desirable to combine features shown in various embodiments into a single embodiment. A different number and configuration of features may be used to construct embodiments of the apparatus and systems that are entirely within the spirit and scope of the present disclosure. Therefore, the spirit and scope of the appended claims should not be limited to the description of the preferred versions contained herein.

Any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" in the claims herein is not intended to invoke the provisions of 35 U.S.C. Section 112, Paragraph 6.

What is claimed is:

1. A modular display system comprising:

a support frame;

a first display module, the first display module comprising:

a first substrate having a first side configured to releasably attach to the support frame, a first plurality of lighting elements mounted on a second side of the first substrate, a first releasable frame coupler coupled to the support frame, the releasable frame coupler defining a first standoff distance from the first substrate to the support frame;

a first pivoting frame coupler coupled to the support frame, the pivoting frame coupler defining a second standoff distance from the first substrate to the support frame; and a first adjustable linkage attached to the pivoting frame coupler, the adjustable linkage defining an adjustable deflection of the first display module, wherein, when activated, the first plurality of lighting elements operate such that they create a first viewing plane; and a second display module, the second display module comprising a second viewing plane, wherein, when the first and second display modules are connected to the support frame, the first viewing plane is adjacent the second viewing plane making a combined viewing plane, the system being configured to present a continuous visual effect across the combined viewing plane.

2. The display system of claim 1, wherein the first display module has a first pitch distance defined by a first distance between each lighting element of the first plurality of lighting elements and the second display module has a second pitch distance defined by a second distance between each lighting element of the second plurality lighting elements and.

3. The display system of claim 1, wherein the second display module comprises:

a second releasable frame coupler coupled to the support frame, the releasable frame coupler defining a first standoff distance from a second substrate to the support frame;

a second pivoting frame coupler coupled to the support frame, the pivoting frame coupler defining a second standoff distance from the second substrate to the support frame; and a second adjustable linkage attached to the pivoting frame coupler, the adjustable linkage defining an adjustable deflection of the second display module.

4. The display system of claim 3, wherein the first pivoting frame coupler tilts the first display module and the second pivoting frame coupler tilts the second display module such that an angle is formed between the first display module and the second display module.

5. The display system of claim 4, wherein the angle between the first display module and the second display module causes each of the first viewing plane and the second viewing plane to have a concave deflection, thereby creating a convex deflection in the combined viewing plane.

6. The display system of claim 3, wherein the first adjustable linkage and the second adjustable linkage each has a neutral state, a compression state, and a tension state.

7. The display system of claim 6, wherein the compression state causes the adjustable deflection to be a convex deflection, and the tension state causes the adjustable deflection to be a concave deflection.

8. The display system of claim 3, wherein the first releasable frame coupler has an attached state and a released state, wherein, when in the released state, the first releasable frame coupler decouples from the support frame allowing the first pivoting frame coupler to tilt such that the first pivoting frame coupler is accessible from outside of the modular display system, and wherein the second releasable frame coupler has an attached state and a released state, wherein, when in the released state, the second releasable frame coupler decouples from the support frame allowing the second pivoting frame coupler to tilt such that the second pivoting frame coupler is accessible from outside of the modular display system.

9. The display system of claim 3, wherein the first display module further comprises a first support rib coupled thereto, the first support rib having a first portion coupled to the first releasable frame coupler and the first pivoting frame coupler, and a second portion containing the first adjustable linkage, and wherein the second display module further comprises a second support rib coupled thereto, the second support rib having a first portion coupled to the second releasable frame coupler and the second pivoting frame coupler, and a second portion containing the second adjustable linkage.

10. A modular display system comprising:

a curved support frame having a first curvature radius;

a first display module having a plurality of light emitting elements mounted on a flexible substrate, the first display module further comprising:

a first releasable frame coupler configured to releasably couple to the curved support frame, the first releasable frame coupler defining a first end standoff distance between a first end of the first display module and the curved support frame when the first display module is coupled to the curved support frame, a first pivoting frame coupler configured to couple to the curved support frame, the first pivoting frame coupler defining a second end standoff distance between a second end of the first display module and the curved support frame when the first display module is coupled to the curved support frame, and a first adjustable linkage attached to the first pivoting frame coupler and the first display module, configured to adjust the second end standoff distance such that the first display module has a second curvature radius, wherein the first adjustable linkage is configured to adjust the second end standoff distance such that the second curvature radius is equal to the first curvature radius.

11. The modular display system of claim 10, further comprising a second display module having a plurality of light emitting elements mounted on a flexible substrate, the second display module being attached to the curved support frame adjacent to the first display module.

12. The modular display system of claim 11, wherein the first display module abuts the second display module along a side therebetween such that the first display module and the display module form a combined viewing plane.

13. The modular display system of claim 11, wherein the second display module further comprises:

a second releasable frame coupler configured to releasably couple to the curved support frame, the second releasable frame coupler defining a first end standoff distance between a first end of the second display module and the curved support frame when the second display module is coupled to the curved support frame, a second pivoting frame coupler configured to couple to the curved support frame, the second pivoting frame coupler defining a second end standoff distance between a second end of the second display module and the curved support frame when the second display module is coupled to the curved support frame, and a second adjustable linkage attached to the second pivoting frame coupler and the second display module, configured to adjust the second end standoff distance such that the second display module has a third curvature radius.

14. The modular display system of claim 13, wherein the third curvature radius is equal to the first curvature radius and the second curvature radius, thereby creating a curved viewing plane comprising the first display module and the second display module.

15. The modular display system of claim 10, wherein the first releasable frame coupler has an attached state and a released state, wherein, when in the released state, the first releasable frame coupler decouples from the curved support frame allowing the first pivoting frame coupler to tilt such that the first pivoting frame coupler is accessible from outside of the modular display system.

16. A display module comprising:

a curved support frame having a first portion having a first curvature radius and a second portion having a second curvature radius, the first curvature radius not being equal to the second curvature radius;

a first display module having a plurality of light emitting elements mounted on a flexible substrate, the first display module further comprising:

a first releasable frame coupler coupled to the curved support frame, the first releasable frame coupler defining a first end standoff distance between a first end of the first display module and the curved support frame when the first display module is coupled to the curved support frame, a first pivoting frame coupler coupled to the curved support frame, the first pivoting frame coupler defining a second end standoff distance between a second end of the first display module and the curved support frame when the first display module is coupled to the curved support frame, and a first adjustable linkage attached to the pivoting frame coupler and the first display module, configured to adjust the second end standoff distance such that the first display module has a third curvature radius; and a second display module having a plurality of light emitting elements mounted on a flexible substrate, the second display module further comprising:

a second releasable frame coupler coupled to the curved support frame, the second releasable frame coupler defining a third end standoff distance between a first end of the second display module and the curved support frame when the second display module is coupled to the curved support frame, a second pivoting frame coupler coupled to the curved support frame, the second pivoting frame coupler defining a fourth end standoff distance between a second end of the second display module and the curved support frame when the second display module is coupled to the curved support frame, and a second adjustable linkage attached to the second pivoting frame coupler and the second display module, configured to adjust the fourth end standoff distance such that the second display module has a fourth curvature radius, wherein the first adjustable linkage is configured to adjust the third end standoff distance such that the third curvature radius is equal to the first curvature radius, and wherein the second adjustable linkage is configured to adjust the fourth end standoff distance such that the fourth curvature radius is equal to the second curvature radius.

17. The display module of claim 16, wherein the first display module abuts the second display module such that the first display module and the second display module form a combined viewing plane.

18. The display module of claim 16, wherein the first releasable frame coupler has an attached state and a released state, wherein, when in the released state, the first releasable frame coupler decouples from the curved support frame allowing the first pivoting frame coupler to tilt such that the first pivoting frame coupler is accessible from outside of the display module.

19. The display module of claim 16, wherein the second releasable frame coupler has an attached state and a released state, wherein, when in the released state, the second releasable frame coupler decouples from the curved support frame allowing the second pivoting frame coupler to tilt such that the second pivoting frame coupler is accessible from outside of the display module.

20. The display system of claim 1, wherein the second display module further comprises:

a second substrate having a first side configured to releasably attach to the support frame, a second plurality of lighting elements mounted on a second side of the second substrate, wherein, when activated, the second plurality of lighting elements operate such that they create the second viewing plane.

* * * * *